US006290383B1

(12) United States Patent
Shohet

(10) Patent No.: US 6,290,383 B1
(45) Date of Patent: Sep. 18, 2001

(54) APPARATUS MIXING, FILTERING, REACTING AND DRYING MATERIALS

(75) Inventor: Albert J. Shohet, Cincinnati, OH (US)

(73) Assignee: Processall, Inc., Cincinnati, OH (US)

( * ) Notice: Subject to any disclaimer, the term of this patent is extended or adjusted under 35 U.S.C. 154(b) by 0 days.

(21) Appl. No.: 09/103,817

(22) Filed: Jun. 24, 1998

(51) Int. Cl.[7] ..... B01F 15/06; B01F 11/04

(52) U.S. Cl. ..... 366/132; 366/144; 366/145; 366/147; 366/149; 366/139; 366/278; 366/276; 366/309; 366/313; 366/325.4

(58) Field of Search ..... 366/132, 147, 366/278, 601, 309, 312, 313, 325.4, 325.92, 329.1, 276, 149, 279, 78, 144–145, 139, 194, 100, 252, 254; 74/813 C, 813

(56) References Cited

U.S. PATENT DOCUMENTS

| | | | | |
|---|---|---|---|---|
| 2,173,715 | * | 9/1939 | Geldhof . | |
| 2,411,138 | * | 11/1946 | Roberts . | |
| 2,650,807 | * | 9/1953 | Bilek . | |
| 3,318,668 | | 5/1967 | Ziehl | 23/270 |
| 3,484,204 | * | 12/1969 | Caviness . | |
| 3,650,319 | * | 3/1972 | Boon . | |
| 3,845,642 | * | 11/1974 | Cochran . | |
| 4,010,932 | * | 3/1977 | Otto . | |
| 4,176,966 | * | 12/1979 | Bornemann | 366/78 |
| 4,187,992 | * | 2/1980 | Del Valle . | |
| 4,229,109 | * | 10/1980 | Benson | 366/24 |
| 4,274,751 | | 6/1981 | Rector et al. | 366/310 |
| 4,473,001 | * | 9/1984 | Rieger . | |
| 4,548,054 | * | 10/1985 | Levine . | |
| 4,676,654 | * | 6/1987 | Fleckner | 366/98 |
| 4,705,222 | | 11/1987 | Shohet | 241/69 |
| 4,836,686 | * | 6/1989 | Sukup | 366/261 |
| 4,893,943 | | 1/1990 | McKelvey | 366/312 |
| 5,139,667 | | 8/1992 | Reneau, Jr. | 210/319 |
| 5,261,746 | | 11/1993 | Boasso | 366/276 |
| 5,275,484 | | 1/1994 | Shohet | 366/132 |
| 5,297,454 | * | 3/1994 | Ito . | |
| 5,645,346 | | 7/1997 | Thuna | 366/205 |
| 5,655,389 | * | 8/1997 | Johnson et al. . | |
| 5,697,703 | | 12/1997 | Lucchetti | 366/198 |
| 5,720,190 | | 2/1998 | Johnson et al. | 68/133 |

* cited by examiner

*Primary Examiner*—W. L. Walker
*Assistant Examiner*—Marianne Ocampo
(74) *Attorney, Agent, or Firm*—Antonelli, Terry, Stout & Kraus, LLP

(57) ABSTRACT

The present invention is an apparatus for processing material having a chamber (100), a rotatably driven shaft (104) extending within the chamber to which is attached at least one element (110) which engages the material (102) in the chamber during rotation thereof and a drive mechanism (150, 170, 200 and 250) for rotating the driven shaft. The process includes (a) driving the driven shaft in one direction while the chamber contains the material in a liquid form while at least one of heat or a vacuum is applied to the chamber from a source 101 to reduce an amount of liquid present in the liquid material; (b) after step (a) driving the driven shaft while at least heat or vacuum is applied to the chamber to reduce an amount of liquid in the material in a first direction to cause the at least one element to engage the material through an angular rotation which lifts the material upward in the chamber while at least heat or vacuum is applied to the chamber to reduce an amount of liquid vehicle in the material in a second direction, opposite to the first direction, to cause the at least one element to engage the material through an angular rotation which lifts the material upward in the chamber; and after step (b), driving the driven shaft in one direction while at least heat or vacuum is applied to the chamber to reduce an amount of liquid to particularize the material.

30 Claims, 9 Drawing Sheets

APPARATUS MIXING, FILTERING, REACTING AND DRYING MATERIALS

TECHNICAL FIELD

The present invention relates to methods and apparatus for processing materials including mixing, drying, reacting and filtering.

BACKGROUND ART

FIGS. 1 illustrates an apparatus 10 which is disclosed in the Assignee's U.S. Pat. No. 5,275,484 which is incorporated herein by this reference in its entirety. The apparatus 10 continually processes liquids and/or solids (materials) including mixing, drying or reacting. A chamber 12 is used for processing of materials. The chamber 12 is comprised of a plurality of zones 14, 16, 18 which may be varied in number and dimension depending upon the particular application and the degree of processing required. The apparatus is supported by a stand 19. The zones 14, 16, 18 are defined by an inner wall 20 of the chamber 12 and weir 22 which is disposed at a boundary between zones within the chamber. An opening 24 extends vertically upward from the weir 22 between adjacent zones within the chamber 12 for permitting the materials to pass from one zone to an adjacent zone. The opening may be produced by a manually adjustable gate 26 which slides horizontally to permit adjustment of the opening 24. A shaft 32 is driven by a motor and gear box (prime mover) 34 for rotating a series of elements 36 which are connected to the shaft by radially extending members 38. The shaft 32 is rotatably supported by bearings 33. The elements 36 contact the material within the zones 14, 16, 18 to promote mixing, drying, and reacting, etc., of the materials within the zones. The elements 36 may have differing shapes promoting agitation, mixing, drying and reactions by moving material contacted by moving elements 36. The design, number and orientation of the mixing elements within each of the zones 14, 16, 18 is varied to control retention time of the matter within the zones. Contacting of the elements 36 with the materials within the zones controls the rate of movement of the material through the opening 24 between the zones and axially within a zone. Each of the elements 36 typically will have substantial surface area 37 which is inclined with respect to the axis of rotation of the shaft 32 to provide a plow-like function to move the material axially within the zone toward the opening 24.

Increasing of the rate of rotation of the shaft imparts additional energy to the materials within each of the zones 14, 16, 18 which increases the rate of movement of the materials through the opening 24 between the zones and decreasing the rate of rotation Decreases the rate of movement of materials through the opening. Additionally, the opening 24 between adjacent zones may be adjusted to be larger to increase the rate of movement of materials through the opening and may be adjusted to be smaller to decrease the rate of movement of materials through the opening.

A programmed controller 40, having an electrical control and logic panel, which may be in the form of a programmed control logic, controls the operation of the various components in the system including the rate of rotation of the shaft 32 produced by the prime mover 34. The programmed controller 40 may be programmed to control a rate of rotating of the shaft by the prime mover 34 to produce programmed contact of the elements 36 with the materials within the zones 14, 16, 18, a programmed rate of movement of the materials through the opening 24 between the zones and axially within a zone and a programmed dwell time of materials within each zone. The controller is programmable to cause the prime mover 34 rotating the shaft 32 for a first time interval at a lower speed to provide a lower rate of movement of the materials through the opening 24 between zones 14, 16, 18, a longer dwell time of a processing of the materials within the zones and to rotate the shaft for a second time interval at a higher speed than the lower speed to provide a higher rate of movement of the materials through the opening between the zones and a shorter dwell time of processing of materials within the zone. Alternatively, the controller 40 is programmable to cause the prime mover to rotate the shaft at a set speed to provide a continuous rate of processing and movement of materials through the opening between zones. The controller 40 may be implemented in any programmable device including a microprocessor or other programmable analog or digital device. The controller 40 includes a memory (not illustrated) for storing a plurality of different programs used for processing different materials which provides the ability to choose stored programs to economically process diverse types of materials without substantial manual overhead, especially when the controller controls all of the variable elements within the apparatus as described below.

A material input 42 controls the flow of materials to be processed by the apparatus and controls the addition of the materials into the first zone 14 and a material output 44 controls the flow of materials which has been finally processed in the final processing zone 18 from the apparatus. Both the material input and the material output 42 and 44 are atmospherically sealed to the chamber 12 with seals (not illustrated) so that non-atmospheric conditions may be provided within the material input, the material output and inside of the chamber during processing. A non-atmospheric pressure source 45 is coupled to the interior of the chamber 12 at one or more of the zones 14, 16, 18 or to the material input 42 or material output 44 to provide either a vacuum to promote drying and the removal of other vapors within the materials being processed or pressurization with gas used for processing materials within the chamber such as during chemical reactions within the chamber. The material input 42 and the material output 44 are provided with valuing to control the addition of materials for processing within the chamber and the removal of processed materials from the chamber while maintaining non-atmospheric pressure. The valving in the material input 42 and the material output 44 may be a pair of valves 46 and 48 which are connected in series in conduit within the material input 42 and the material output 44.

The valves 46 and 48 may be of diverse form including, but not limited to, slide gate valves as illustrated or ball or butterfly valves, etc. In order to control the pressure within the chamber 12 at non-atmospheric pressure, the valves 46 and 48 are operated under the control of the controller 40 to control movement of the materials through the material input 42 into the first zone 14.

The lower valve 48 in the material input 42 is controlled by the controller 40 to be closed while the upper valve 46 is controlled by the controller 40 to be open to seal the chamber 12 from atmospheric pressure and the hopper 106 during conveying of materials by the material input for addition to the first zone 14. Thereafter, the upper valve 48 is closed by the controller 40 to seal the materials conveyed by the material input from atmospheric pressure between the upper and lower valves. Finally, the lower valve 48 is opened by the controller 40 to cause the materials between the lower and upper valves to be added to the first zone 14. The above-described sequence of operation of the valves in the material output 42 is repeated cyclically during the continuous processing performed by the invention.

The lower valve 48 in the material input 44 is controlled by the controller 40 to be closed while the upper valve 46 in the material output is opened during discharge of materials from the last zone 18. Thereafter, the upper valve 46 in the material output 44 is closed by the controller 40 to seal the discharged materials between the valves from atmospheric pressure. Finally, the lower valve 48 is opened to cause the materials between the lower and upper valves 46 and 48 of the material output 44 to be moved between the valves typically by the effect of gravity. The above-described sequence of operation of the valves in the material output 44 is repeated cyclically during the continuous processing produced by the present invention. Vacuum, pressure or vibrating devices can be added to aid in the charging or discharging of the valves.

The material input 42 may contain miscellaneous processing equipment 51 such as, but not limited to, an agglomerating device for spraying liquid into powder introduced into hopper 106 to produce agglomeration of the powder or a high intensity agitator for purposes of predispersion of minor ingredients prior to introduction into the first zone 14 of the chamber 12. FIG. 6 described below illustrates an agglomerating device which may be disposed within the material input 42.

The chamber 12 contains the following additional structures. A removable lid 56 is mounted in the top section of the chamber 12 to permit access to each of the zones 14, 16, 18 including adjustment of the openings 24. A filtration screen may be disposed in one or more of the zones 14, 16, 18 in either the bottom or in the side of the chamber 12 for permitting liquid separation of liquids and solids disposed within the zones by liquid flowing through the screen outside the chamber. The filtration screen is periodically back-flushed during operation to prevent accumulation of excessive solids from occluding (blinding) the screen which would interfere with draining of liquid from the chamber when the invention is being used to filtrate materials containing undesired liquid components through the filtration screen. Viewing ports 60 may be disposed in the side walls of the chamber 12 to permit visualization of the processing within the chamber 12. Additionally, spray balls 62 may be installed to permit cleaning of the interior of the chamber 12 between processings.

A jacket may be provided in contact with the inner wall 20 of the chamber 12 and/or a jacket in contact with the weir(s) 22 and/or a hollow shaft 32 (not illustrated) for receiving cooling or heating fluids for controlling the temperature within the chamber for a suitable fluid source (not illustrated). A plurality of fluid ports are provided for coupling fluid to the jacket and outputting fluid from the jacket from the fluid source. Heated fluid may be coupled to the jacket to heat the chamber 12 to promote drying of product which is typically conducted under sub-atmospheric pressure. Cooling fluid may be coupled to the jacket to cool the chamber 12 to absorb heat generated by exothermic chemical reactions taking place within the zones 14, 16, 18. Diverse types of heating and cooling fluids may be utilized in conjunction with the jacket to provide precise control of temperature conditions within the chamber 12. For example, the jacket may be sectorized (not illustrated) such that each processing zone 14, 16, 18 is thermally coupled to a single jacket which receives fluid having the required temperature for processing the materials within the processing zone coupled to the jacket sector. Other means of introducing heating, such as gasses, infrared or microwave (not illustrated) may be used for thermal treatment.

The material output 44 may include an agitator disposed within the final zone 18 for contacting the material to cause the material to flow into the material output. The agitator may include an eccentric 112 mounted on the shaft 32. A member 114 is connected to the eccentric which extends into the material output 44 with rotation of the eccentric causing the member to reciprocate within the material output. As a result, any tendency of a finally processed solid to agglomerate or bridge is reduced to provide a uniform flow rate of finally processed material from the material output 44. Vibrators or air pads may also be used in the material movement through the input and output devices 42 and 44.

FIG. 2 illustrates a perspective view of a prior art multipurpose mixer which is disclosed in the Assignee's U.S. Pat. No. 4,705,222 which is incorporated herein by reference in its entirety. The apparatus 10' is positioned in an angular orientation for performing a specific mixing operation. The main parts of the apparatus 10' are a drum assembly 12', including a driven main axial drive shaft (not illustrated), a main housing 14', a detent pin mechanism 17' for locking the drum in any one of a plurality of angular positions. A support stand 16' is provided which supports the axis of rotation 17' of the driving assembly 12'. A control panel 18' contains controls for activating and controlling the speed of two motor drives and an ammeter used for monitoring the current draw by the motor which drives the main drive shaft located axially within the drum assembly 12. Preferably the motor for driving the main driven shaft is of variable speed with at least two selectable speeds to permit the drive shaft to be driven at speeds designed for diverse types of mixing operations as described below. The second motor drive 20' extends through the outside wall of the drum assembly orthogonally into the chamber formed by the drum for driving a high sheer deagglomerating impeller. The drum has a first end 22' which is removable from cylindrical section 23'. A clamp 24' is attached to the outside cylindrical section 23' and the first end 22' of the drum assembly 12' to lock the first end in place during operation. The clamp 24' also locks the drum assembly 12' to the main housing 14'. The part of the clamp 24' which clamps the first end of the drum in place is openable to permit the first end to be removed to place missing element assemblies on the main drive shaft. The first end 22' of the drum assembly 12' includes a port 26' which is located near the periphery of the first end at a position offset from the centrally disposed drive shaft. The port 26' includes a hollow cylindrical section 28' which has a first end which communicates with the interior of the drum assembly 12' and a second end having a closure 30' which is removable to permit materials to be placed inside of and removed from the drum assembly 14'. Typically, the materials are added to the drum while it is in its "vertical up" position and removed when it is in its "vertical down" position. The closure 30' is held in place by a clamp 32'. A plurality of holes 42' are drilled in the side panel of the main housing 14' or receiving the detent pin assembly 30' mounted in the upright portion of the support stand 16'. The controls for the motor drives are conventional.

FIG. 3 illustrates a sectional view of the apparatus of FIG. 2 used in the horizontal mixing mode. The drive shaft 46' is driven by a variable speed motor 48' which is controlled from the control panel 18'. The drive shaft 46' is rotatably supported in the second end 50' of the drum assembly 12' by a bearing 52'. A seal 54' is provided for preventing the bearing 52' from being contacted by materials being mixed within the drum assembly 12'. The drive shaft 46' has an extension 56' which is coupled to the variable speed motor 48' to couple rotary motion to the mixing elements 56' which are attached at spaced apart locations to a hollow cylindrical sleeve 58' which has an inner surface which contacts the outer surface of the drive shaft 46'. A hole 60' is diametrically drilled through the cylindrical sleeve 58' and the drive shaft 46' for receiving a pin (not illustrated) for locking the cylindrical sleeve 58' which drives the mixing elements 56' to the drive shaft 46'. Preferably, the mixing elements 56' are plow-shaped elements of well-known construction. The cylindrical section 23' is of double walled construction to form a jacket 61' useful for applications requiring heating or cooling. The port 61" is coupled to a suitable heat or cooling source to control the temperature of the mixing chamber. Each element 56' contains at least one sloped surface 62' which is inclined upward toward the drive shaft 46' to impart lift to materials being contacted by rotation of the mixing element. The individual mixing elements 56' are attached to the hollow cylindrical sleeve 58' by radial arms 64'. The arm 64' located closest to the second end 50' of the drum assembly 12' has a 90° bend to permit the attachment point to the hollow cylindrical sleeve 58' to be axially offset from the position of the mixing element within the drum assembly 12'. The remaining three arms 64' are straight. The end of the drive shaft 46' is offset slightly from the first end 22' of the drum assembly. A deagglomerating impeller 68' projects orthogonally inward from the inner wall of the drum assembly 12' at a point midway between the first end 22' and the second end 50'. The deagglomerating impeller 68' includes a blade assembly 72' which is attached to a drive shaft 74' which is coupled to a motor 20'. The deagglomerating impeller drive shaft 74' is sealed against leakage by a sealing assembly 76'. The deagglomerating impeller 68' is used to control particle size of materials being mixed within the drum assembly 12' and to disperse any liquids. While the present invention is preferably used to perform horizontal mixing with the mixing element assembly as illustrated, it should be understood that other mixing element assemblies may be used which are designed for mixing particular materials or performing particular types of mixing actions while the drive shaft 46' is in the horizontal position.

U.S. Pat. No. 5,261,746 discloses a method of transporting and blending slurries in a sealed chamber with an oscillating paddle system. The system of the '746 Patent is used in conjunction with viscous slurries such as mash comprised of insolubles carried in a liquid. A driven shaft which rotates about a horizontal axis oscillates through a limited degree of rotation in order to lift the fluid mass from confining ends of the chamber to the center portion of the container. The paddles are offset by 90° so that lifting of the fluid mass at opposite sides of the container occurs upon rotation of the shaft in alternate directions. Rotation in each direction between 90° to 360° is described. The liquid content of the chamber is not varied during rotation.

Most mixers, filters, dryers and chemical reactors utilize rotary motion inside of a cylindrical vessel which is either positioned vertically or horizontally. The use of rotary motion in these devices is complete rotary motion in which a mixing shaft is rotated in one direction to which are attached one or mixing elements which are typically rotated at either relatively slow or fast speeds.

Rotary motion in one direction in mixing devices is typified by several problems. The mixing action is typically so intense that it can change the particle size of the product mixed. During washing and filtration, the complete rotary motion can stir a slurry too fast making it harder to disengage during the filtration mode.

During drying of some products, the material changes from a liquid phase typically in the form of a slurry to a very viscous doughy phase which causes the product to form spaghetti-like strings that wrap around and stick to the drive shaft. The drying cycle is either stopped or substantially slowed because of inadequate contact with a heat and/or vacuum source. Large agglomerates and heavy buildup around the drive shaft inhibit further processing. These problems can occur when the assignee's aforementioned patents are utilized to perform drying operations in which the drive shaft is disposed in a nonvertical mode.

Additionally, certain types of substances which require a gentle mixing, coating or drying are damaged by contact caused by the mixing elements rotating at high speed in devices which use one-way rotation of driven shaft, such as the prior art apparatuses described above in conjunction with FIGS. 1–3.

DISCLOSURE OF THE INVENTION

The present invention is a process for processing material with a processing system having a chamber, a rotatably driven shaft extending within a chamber to which is attached at least one element which engages the material in the chamber during rotation thereof and a drive mechanism for rotating the driven shaft and an apparatus for processing material in which oscillating rotational movement of the drive shaft is utilized in a first direction to cause the at least one element to engage the material with an angular rotation which lifts the material in the chamber and then in a second direction, opposite to the first direction, to cause the at least one element to engage the material with an angular rotation which lifts the material in the chamber. The oscillating rotational movement is typically an intermediate phase of a process wherein a liquid material is processed with a three-phase process in which the first phase of the process has the driven shaft rotated in one direction during which a liquid is evaporated from the material followed by the aforementioned rotation in the first and second directions, followed finally by rotation of the driven shaft in one direction to particularize the material. However, it should be understood that the present invention is not limited to the aforementioned three-step process. Preferably, in applications in which the aforementioned three phase process is utilized when the material is typified by forming a viscous doughy-like consistency which will stick to the drive shaft, the intermediate phase of the process involving rotation in the first and second directions does not lift the material upward beyond a level of the material over the driven shaft in the chamber which prevents the material from falling onto the drive shaft and sticking thereto which interferes with or prevents effective drying as in the prior art.

In a preferred application of the present invention, independent power sources are utilized for rotating the driven shaft in the one direction during the first and third phases of the process and the oscillating rotation in the first and second directions during the second phase of the process. Processing required for the first and third phases of the process is effectively performed by a relatively high speed rotation of the driven shaft for agitating the highly liquid phase in the first part of the process and granulating the product during the final phase of the process after the intermediate processing of oscillating the shaft in the first and second directions. A combination of heat and/or vacuum is preferably used in the three phases of the process to facilitate the removal of the liquid.

The independent drive utilized for the intermediate phase oscillation of the driven shaft in the first and second directions permits effective reversing of the drive shaft at low speed to accomplish lifting of the material being processed, which may be the form of a dough-like slurry. The independent drive of the driven shaft during second phase typically is geared down from a prime mover smaller than the prime mover for the first and third phases to apply increased torque to the drive shaft at low speed to facilitate the alternative lifting of material. Furthermore, the use of independent drives permits the intermediate phase of the process to be disabled to permit conventional one-way shaft rotation to be used for mixing, drying, reacting and filtering operations as in the prior art. One preferred form of the independent drive utilizes either a single or double rack and pinion drive to apply torque directly to the output of the driven shaft and another preferred form uses a pair of electric motors connected to the driven shaft through gear reducers and a clutch. The mixing elements are spaced from the interior surface of the chamber to avoid direct contact which would shorten their useful life because of frictional engagement with the mixing chamber.

The oscillation of the driven shaft allows the one or more elements attached thereto to rock back and forth to avoid making a complete revolution while lifting the product in contact with them to promote driving off of the liquid typically in the presence of heat and/or vacuum while keeping the material from wrapping around the driven shaft because it is not lifted directly above the shaft to a position at which it would fall from the mixing elements into contact with the driven shaft and stick thereto. The oscillation of the at least one element attached to the driven shaft may be made gentle to avoid applying successive shear to aggregate which produces overwetting. The oscillating motion during the intermediate phase of the process converts the product from a dough-like consistency into semi-dry clusters which are broken up in the final one-way rotational direction of the driven shaft using an existing built-in mill which chops and converts the material to a powder without sticking to the shaft or the walls of the chamber to solve the problem of the prior art discussed above.

It should be understood that various forms of independent drive mechanisms may be used, such as plural motors, rack and pinion drives, simple harmonic motion, levers, linkages, speed reducing devices, indexing drives, variable speed electrical motor drives, electromechanical drives, etc. Furthermore, it should be understood that the invention is not limited to any particular form of element attached to the driven shaft.

A process for processing material with a processing system having a chamber, a rotatably driven shaft extending within the chamber to which is attached at least one element which engages the material in the chamber during rotation thereof and a drive mechanism for rotating the driven shaft in accordance with the invention includes while the chamber is partially filled with the material rotating the driven shaft in a first direction to cause the at least one element to engage the material through an angular rotation which lifts the material upward beyond a level of the material in the chamber without reaching a position which is directly above the driven shaft and then rotating the driven shaft in a second direction, opposite to the first direction, to cause the at least one element to engage the material through an angular rotation which lifts the material upward beyond the level of the material in the chamber without reaching a position which is directly above the driven shaft. The material during the rotation of the driven shaft in the first and second directions is typically sufficiently viscous that the material would stick to the driven shaft if the material were to contact the driven shaft. The driven shaft is driven through a plurality of sequential cycles with each cycle including rotation in the first and second directions. Furthermore, the driven shaft is rotated in one direction to cause the material to increase in viscosity during rotation in one direction prior to rotating the driven shaft in the first and second directions; and after completion of rotating the driven shaft in the first and second directions, rotating the driven shaft in one direction to particularize the material. Heat and/or vacuum may be applied to the material in the chamber during the first phase of the process of rotating the driven shaft in the first direction, during the rotating of the driven shaft in the first and second directions during the intermediate phase of the process and during the rotating of the driven shaft in the one direction in the last phase of the process during rotation in the one direction to drive off liquid present in the material. The at least one element is spaced from a wall of the chamber during rotation to prevent excessive wear.

Preferably, the drive mechanism includes a first prime mover for rotating the driven shaft in the one direction and a second prime mover for rotating the driven shaft in the first and second directions.

An apparatus for processing material in accordance with the invention includes a chamber for containing the material, a rotatably driven shaft extending within the chamber to which is attached at least one element which engages the material in the chamber during rotation thereof, a drive mechanism for rotating the driven shaft, and a control for controlling the drive mechanism wherein the control controls the drive mechanism to rotate the driven shaft in the first direction to cause the at least one element to engage the material while the chamber is partially filled with the material through an angular rotation which lifts the material upward beyond a level of the material in the chamber without reaching a position which is directly above the driven shaft and then the control controls the drive mechanism to rotate the driven shaft in a second direction, opposite to the first direction, to cause the at least one element to engage the material through an angular rotation which lifts the material upward beyond a level of material in the chamber without reaching a position which is directly above the driven shaft. The control controls the drive shaft to drive the driven shaft in the first and second directions while the material is sufficiently viscous so that the material would stick to the driven shaft if the material were to contact the driven shaft. The control controls the drive mechanism to rotate the driven shaft through a plurality of sequential driven cycles with each cycle including rotation in the first and second directions. The control controls the drive mechanism to rotate the driven shaft in one direction to cause the material to increase in viscosity during the rotation in one direction prior to controlling the drive mechanism to rotate the driven shaft in the first and second directions; and after completion of rotating of the driven shaft in the first and second directions, the control controls the drive mechanism to rotate the driven shaft in one direction to particularize the material. A heat source and/or a vacuum source may respectively add heat an/or apply vacuum to the material during rotation of the driven shaft in the one direction and in the first and second directions to drive off liquid present in the material. The at least one element is spaced from a wall of the chamber to prevent excessive wear. The drive mechanism preferably includes a first prime mover which is controlled by the control which rotates the driven shaft in the one direction; and a second prime mover, which is controlled by the control which rotates the driven shaft in the first and second directions.

A process for processing material with a processing system having a chamber, a rotatably driven shaft extending within the chamber to which is attached at least one element which engages the material in the chamber during rotation thereof and a drive mechanism for rotating the driven shaft includes rotating the driven shaft with the drive mechanism in one direction while the chamber contains the material in a liquid form while at least one of heat and/or a vacuum is applied to the chamber to drive off liquid present in the liquid material; after rotating of the driven shaft in one direction, rotating the driven shaft with the drive mechanism while at least one of heat or vacuum is applied to the chamber to drive of f the liquid present in the material in a first direction to cause the at least one element to engage the material through an angular rotation which lifts the material and then rotating the driven shaft in a second direction, opposite to the first direction to cause the at least one element to engage the material through an angular rotation which lifts the material upward; and after rotating the driven shaft in the first and second directions rotating the driven shaft in one direction while at least heat and/or a vacuum is applied to the chamber to drive off liquid present in the material to particularize the material. During rotation in the first and second directions, the material is lifted above a level of the material in the chamber without reaching a position which is directly above the driven shaft. The material is sufficiently viscous during rotation in the first and second directions that the material would stick to the driven shaft if the material were to contact the driven shaft. The driven shaft is driven through a plurality of sequential cycles with each cycle including rotation in the first and second directions.

A process for processing material with a processing system having a chamber, a rotatably driven shaft extending within the chamber to which is attached at least one element which engages the material in the chamber during rotation thereof and a drive mechanism for rotating the driven shaft in accordance with the invention includes applying at least one of heat or vacuum to the chamber which drives off liquid present in the material while rotating the driven shaft in a first direction to cause the at least one element to engage the material through an angular rotation which lifts the material upward and then rotating the driven shaft in a second direction, opposite to the first direction, to cause the at least one element to engage the shaft through an angular rotation which lifts the material upward. The material is lifted upward during the rotation in the first and second directions above a level of material in the chamber without reaching a position which is directly above the driven shaft. The material is sufficiently viscous during rotation in the first and second directions that the material would stick to the driven shaft if the material were to contact the driven shaft. While applying at least one of heat or vacuum to the chamber which drives off liquid present in the material, the driven shaft is driven through a plurality of sequential cycles with each cycle including rotation in the first and second directions. While applying at least one of heat or vacuum to the chamber which drives of f liquid present in the chamber rotating the driven shaft in one direction to cause the material to increase in viscosity prior to rotating the driven shaft in the first and second directions; and after completion of rotating the driven shaft in the first and second directions, rotating the driven shaft in one direction to particularize the material.

An apparatus for processing material in accordance with the invention includes a chamber for containing the material, a rotatable driven shaft extending within the chamber to which is attached at least one element which engages the material in the chamber during rotation thereof, a drive mechanism for rotating the driven shaft, at least one of a vacuum source or a heat source applied to the chamber which drives off liquid present in the material during rotation of the driven shaft by the drive mechanism and a control for controlling the drive mechanism and wherein the control controls the drive mechanism to rotate the driven shaft in a first direction to cause at least one element to engage the material through an angular rotation which lifts the material upward and then the control controls the drive mechanism to rotate the driven shaft in a second direction, opposite to the first direction, to cause the at least one element to engage the material through an angular rotation which lifts the material. The material is lifted upward during the rotation in the first and second directions above a level of material in the chamber without reaching a position which is directly above the driven shaft. The control controls the drive mechanism to rotate the driven shaft in the first and second directions while the material is sufficiently viscous that the material would stick to the driven shaft if the material were to contact the driven shaft. The control controls the drive mechanism to rotate the driven shaft through a plurality of sequential cycles with each cycle including rotation in the first and second directions. The control controls the drive mechanism to rotate the driven shaft in one direction to cause the material to increase in viscosity prior to controlling the drive mechanism to rotate the driven shaft in the first and second directions; and after completion of rotating of the driven shaft in the first and second directions, the control controls the drive mechanism to rotate the driven shaft in one direction to particularize the material.

BRIEF DESCRIPTION OF THE DRAWINGS

Like reference numerals identify like parts throughout the drawings.

BEST MODE CARRYING OUT THE INVENTION

The present invention may be practiced in diverse forms of apparatus, such as, but not limited to, the apparatuses described in the Assignee's U.S. Pat. Nos. 4,705,222 and 5,275,484 described above. In practicing the present invention with apparatuses in accordance with the aforementioned patents, the drive mechanism and control is modified to provide both driving of the drive shaft therein in one direction as is conventionally done in those apparatuses and oscillatory drive through a limited degree of rotation as described below with reference to FIG. 5 in first and second directions. Preferred forms of the drive mechanism are described below with reference to FIGS. 7, 8A and 8B, 9A and 9B, and 10A and 10B. The details of the infeed and outfeed of processed materials into and out of the chamber may be in accordance with the systems as described in the Assignee's above-referenced patents and are not hereinafter described. However, it should be understood that the present invention is not limited to material infeed and outfeed mechanisms in accordance with the above-referenced patents.

Figure 1:
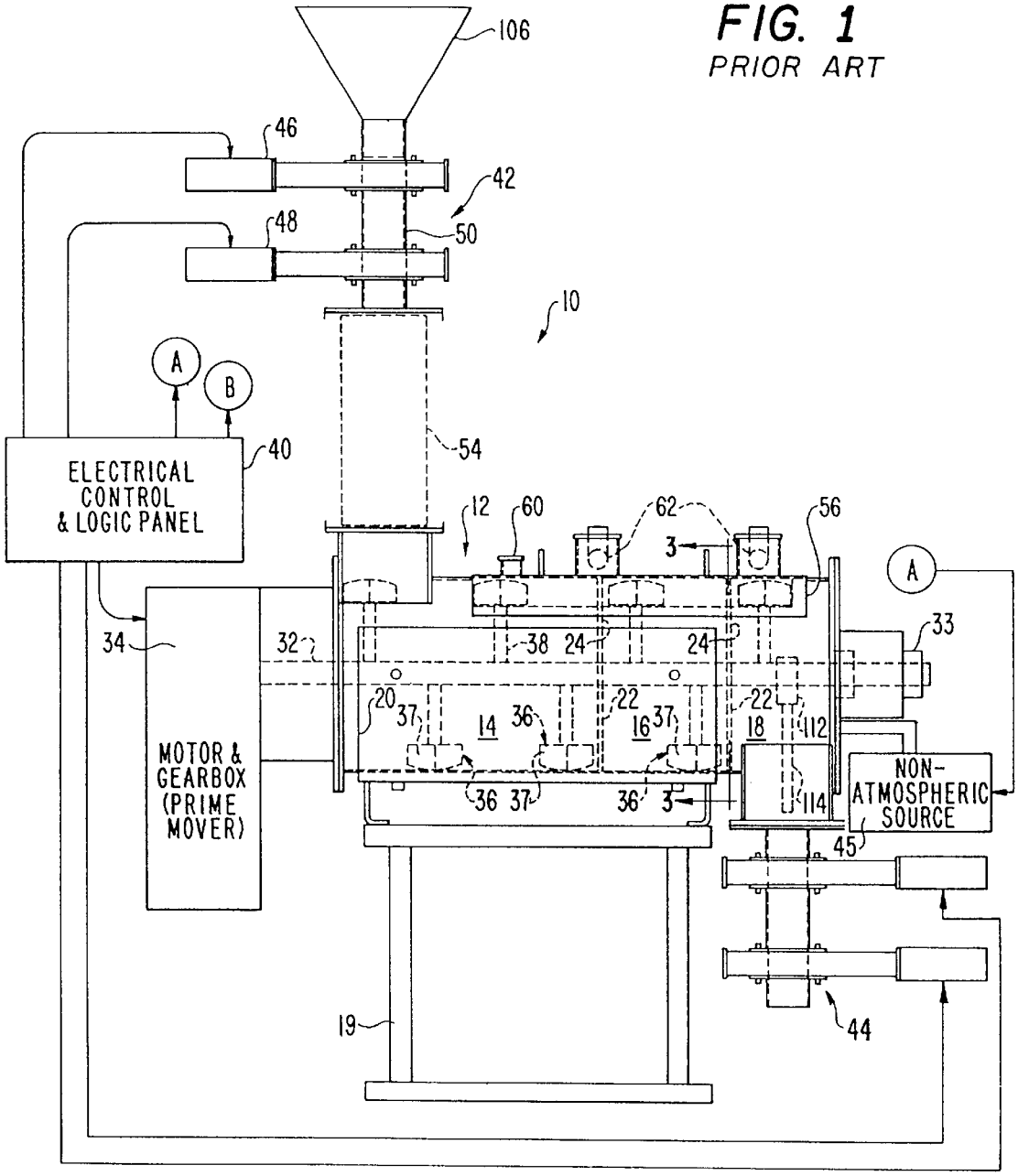
FIG. 1 PRIOR ART
FIG. 1 is a side elevational view of a mixing apparatus in accordance with the Assignee's U.S. Pat. No. 5,275,484.
Figure 2:
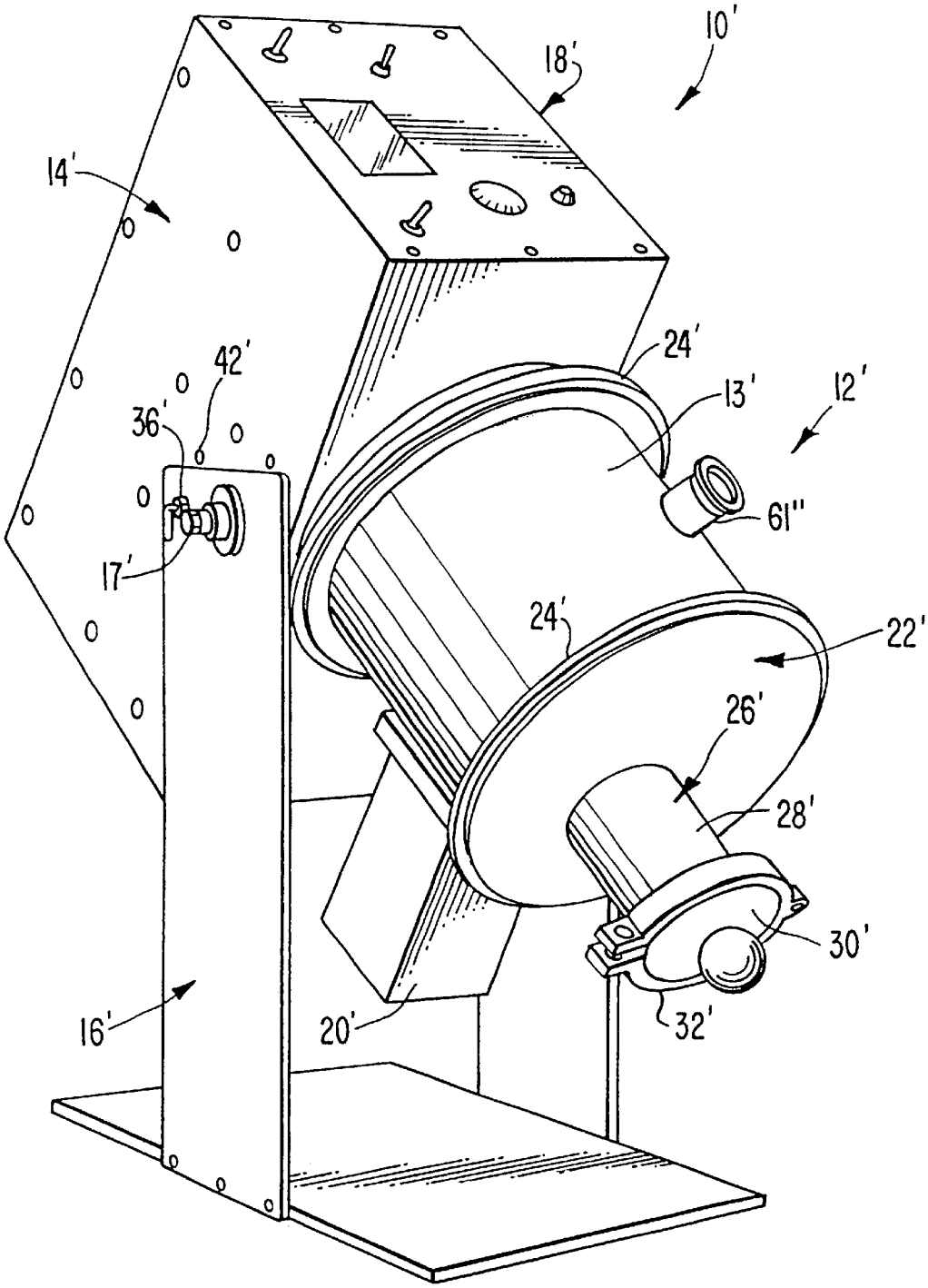
FIG. 2 PRIOR ART
FIG. 2 is an isometric view of a mixing system in accordance with the Assignee's U.S. Pat. No. 4,705,222.
Figure 3:
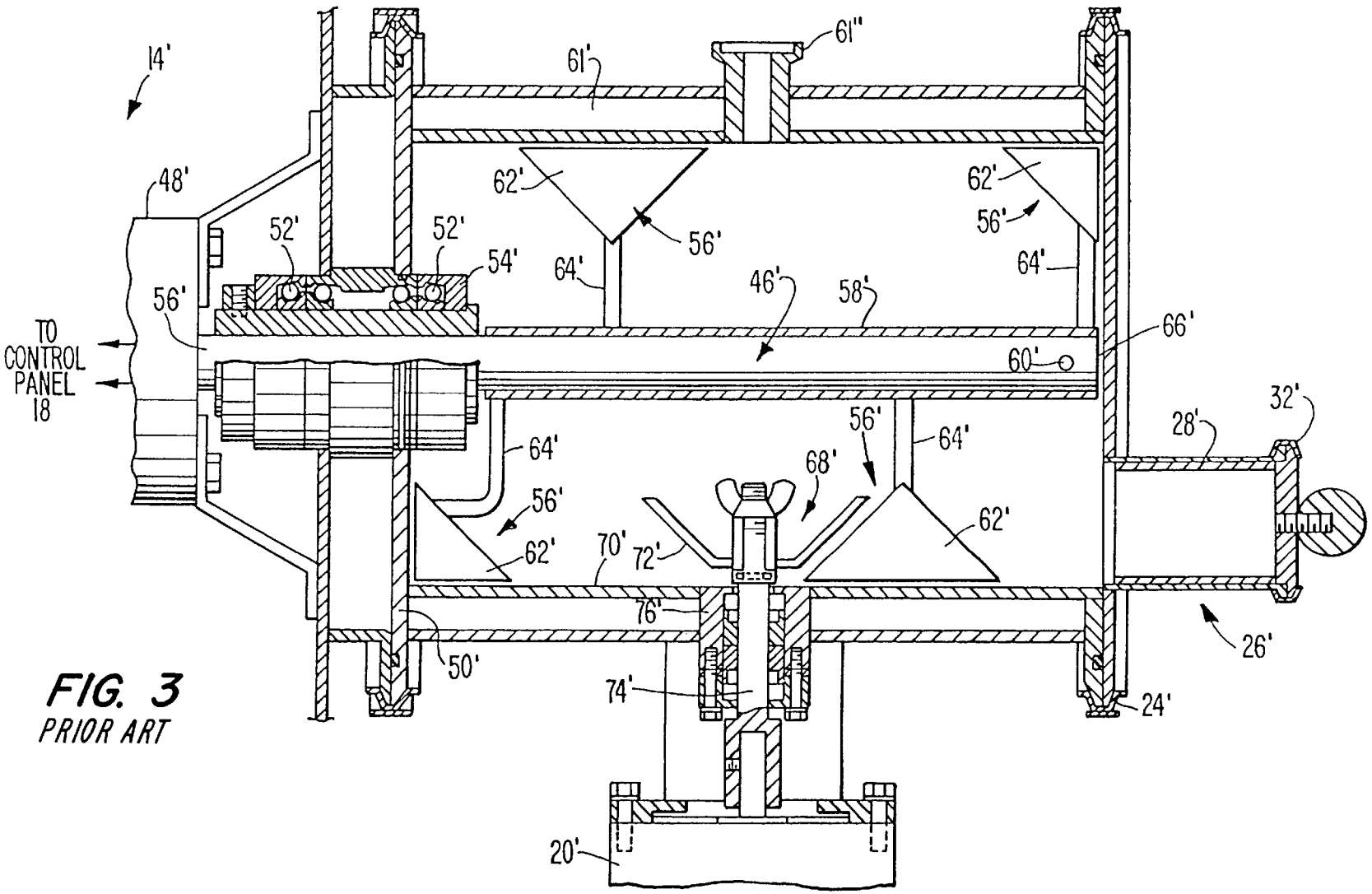
FIG. 3 PRIOR ART
FIG. 3 illustrates a sectional view of the mixing chamber of FIG. 2 of the Assignee's U.S. Pat. No. 4,705,222.
Figure 4:
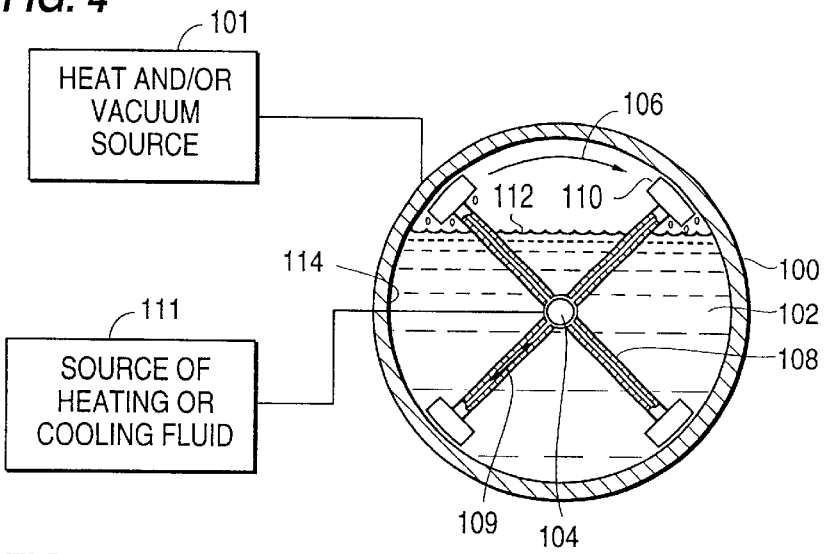
FIGS. 4–6 respectively illustrate the three phases of processing of material in accordance with a preferred embodiment of the present invention.
Figure 5:
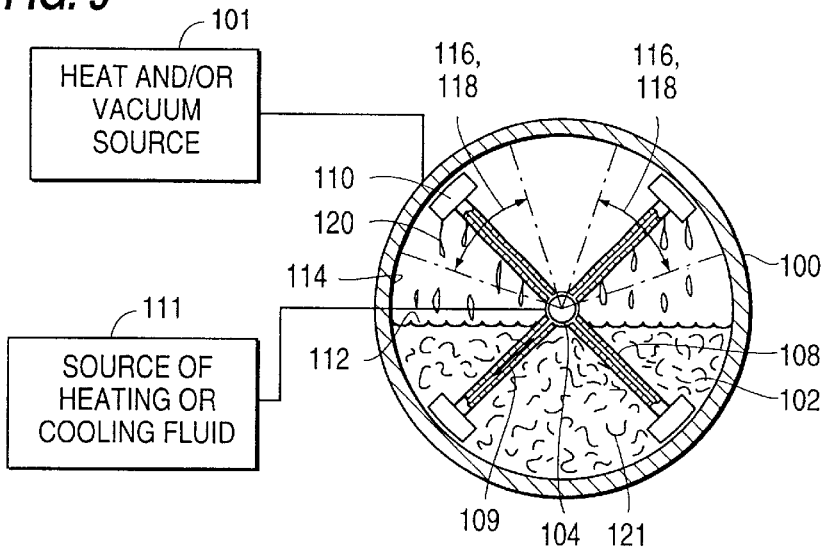
Figure 6:
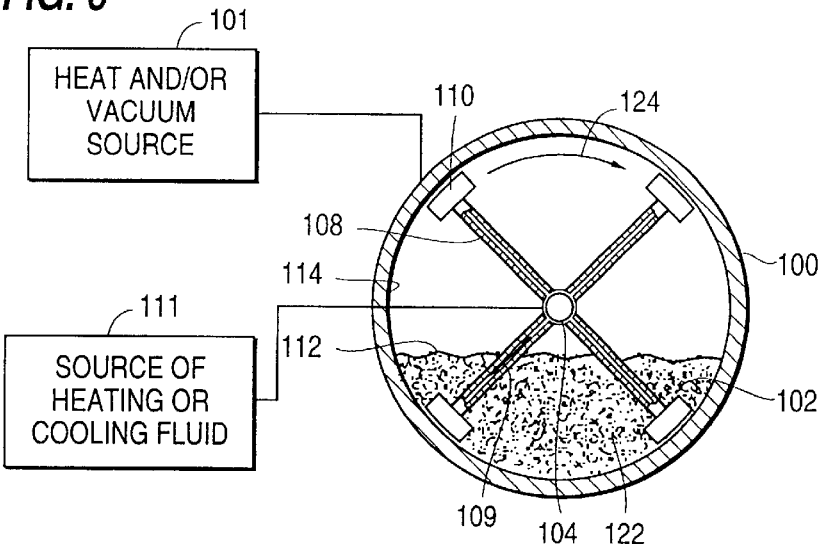

FIGS. 4–6 illustrate an end view of the processing chamber 100 during three processing phases which are a preferred application of the present invention in which a material initially in liquid form is processed sequentially from a liquid phase of FIG. 4 through a dough-like phase of FIG. 5 to a granulation phase of FIG. 6. However, it should be understood that the present invention is not limited to the processing phases of FIGS. 4–6 and further that the oscillation of the drive shaft at a lower speed than the one-way rotation of FIGS. 4 and 6 through a limited angular degree of rotation may be used alone to coat or otherwise process materials which would be damaged by the one-way rotation of the drive shaft at high speed. The chamber 100 has applied thereto a combination of heat and/or vacuum from source 101 in accordance with the prior art of FIGS. 1–3 for promoting the removal of the liquid 102 which contains the material which is being particularized typically into fine granules. Drive shaft 104 is rotated in one direction 106 to agitate the material 102 with a drive mechanism (not illustrated) as described below with reference to FIGS. 7, 8A and B, 9A and B and 10A and B. The drive shaft 104 has at least one and preferably a plurality of arms 108 which project radially outward to a point of attachment of elements 110 which are spaced from an inside wall of chamber 100 to prevent excessive wear and are designed to perform diverse functions, such as mixing, milling, etc. The bidirectional arrows 109 represent heating or cooling fluid from a source 111 of heating or cooling fluid which facilitates heat transfer to and from the product. Different forms of the elements 110 may be used to practice the present invention and examples of suitable elements are discussed below with reference to FIGS. 11A–11D. As is illustrated in FIG. 4, the chamber 100 at the beginning of processing typically contains a quantity of liquid 102 having a liquid level 112 above the shaft but which does not completely fill the chamber which permits the application of vacuum, forced hot air or the application of heat through the interior wall 114, as generically indicated by heat and/or vacuum source 101 and may be by means of a thermal jacket to drive off the liquid to produce during the continued rotation of the drive shaft 104 a continuous reduction in the amount of liquid present in the liquid material 102. The process of FIG. 4 is conventional and is the first phase of the three phase process of FIGS. 4–6 which ultimately results in a fine granulated product.

FIG. 5 illustrates the second intermediate phase of the process in which the liquid level has been reduced to reduce the product level typically to below the shaft 104. The shaft 104 is driven alternatively in a first direction 116 and a second direction 118. Preferably, the shaft 104 is driven by the drive mechanism (not illustrated) in the first direction 116 to cause at least one element 110 to engage the material 102 through an angular rotation which lifts the material upward beyond the level 112 of the material in the chamber 100 without reaching a position which is directly above the driven shaft 104 and then drives the driven shaft in the second direction 118, opposite to the first direction, to cause the at least one element 110 to engage the material 102 through an angular rotation which lifts the material upward beyond the level of the material in the chamber without reaching a position which is directly above the driven shaft. The rotation in the first and second directions 116 and 118 is repeated sequentially many times, is typically at a much lower rotational speed then the rotations in the directions 106 and 124 as illustrated in FIGS. 4 and 6 and is preferably powered by a drive mechanism which is independent of the drive mechanism which provides the rotation in the direction 106 in illustrated FIG. 4 and in direction 124 as illustrated in FIG. 6. During the processing of FIG. 5, the application of heat and/or vacuum from heat/or vacuum source 101 to the chamber 100 drives off additional liquid to cause the material to reach a doughy-like consistency where it is quite heavy and tacky and has a viscosity where it will form string-like sections 120 which would wrap around the shaft 104 if the elements 110 were to lift the material below the level 112 above top dead center of the shaft 104 and beyond. As illustrated, the string-like sections 120 fall back into the material 102, as illustrated in FIG. 5, without engaging the driven shaft 104. The alternative rotation of the driven shaft in the first and second directions 116 and 118 through a limited degree of angular rotation preferably without the elements 110 reaching top dead center eliminates the problem of the prior art where wrapping of the thick viscous material around the driven shaft resulted from rotation of the drive shaft in one direction when the material was sufficiently viscous to form the string-like sections. The string-like sections, if wrapped around the driven shaft, produce a substantial decrease in the efficiency of the drying process with possible total failure and further result in excessive energy consumption typified by a requirement of much higher torque to power the rotational elements. The relatively thick viscosity of the material required the motor driving the driven shaft to lift a substantial amount of the material sticking to the elements upward resulting in a substantial consumption of energy because the electric motor was operating near a stalling speed.

As is illustrated in FIG. 5, the material below the level 112 is of a doughy-like consistency which tends to form agglomerates 121 as the liquid content is continually reduced within the chamber 100 by the application of heat and/or vacuum from the heat or vacuum source 101.

The processing of FIG. 5, while preferably being utilized in the three phase process of FIGS. 4–6, has applications which do not require a sequence of going from a liquid phase, as illustrated in FIG. 4, to a particularized, pulverized and granulated material, as illustrated in FIG. 6. For example, certain materials which require a surface coating to be gently applied to the material without breaking the material into pieces, may take advantage of the alternative rotation of the elements 110 in the first and second directions 116 and 118 at a slower controlled speed than the speed of rotation which typifies the prior art rotation in one direction. The materials being processed with the oscillating motion of FIG. 5 do not have to be of the thick viscous consistency typifying the process, as illustrated in FIG. 5, where the materials would, if lifted directly above the shaft 104, stick directly thereto causing substantial interference with or outright failure of the drying and particularizing operation in accordance with excessive energy consumption.

FIG. 6 illustrates the third phase of processing in accordance with a preferred application of the present invention in which the material is granulated into fine particles 122 with the application of heat and/or vacuum from source 101. In this phase, the drive shaft 104 is again driven in one direction 124 in accordance with the prior art to produce particularization.

However, because of the efficient removal of the liquid produced by the alternative rotations of the drive shaft 104 in the first direction 116 and the second direction 118 as illustrated in FIG. 5, the energy consumption and the time of processing to drive off the liquid to a point where granulation may take place has been substantially enhanced (reduced). The increased efficiency of the processing of FIG. 5, which lessens the overall processing time to perform the processing phases of FIGS. 4–6, is resultant from the elements 110 alternatively moving in the first and second directions 116 and 118 which applies a gentle but effective lifting of the material to minimize coating of the inside wall 114 of the chamber 100, coating of the driven shaft 104 and provides a greater exposure of surface area of the material being processed to heat and/or vacuum from source 101 which promotes driving off of the liquid present therein. The rotation in the first and second directions 116 and 118 does not produce damage to the consistency of the material being processed and prevents the material from being taken out of thermal contact with the inside wall 114 of the chamber 100 which reduces the efficiency of heat transfer through the chamber wall and further reduces the surface area exposed to vacuum and/or heat applied to the space in the chamber above the material level 112 from the heat and/or vacuum source 101. The rotation of the shaft 104 in one direction 124 in FIG. 6 occurs for a sufficient time for the combination of heat and/or vacuum applied to the interior of the chamber 100 from heat and/or vacuum source 101 to be sufficient to remove the liquid and to bring the dryness of the material to a point where conventional grinding can occur under the action of the one or more elements 110 because the material is no longer sufficiently wet to stick together.

Figure 7:
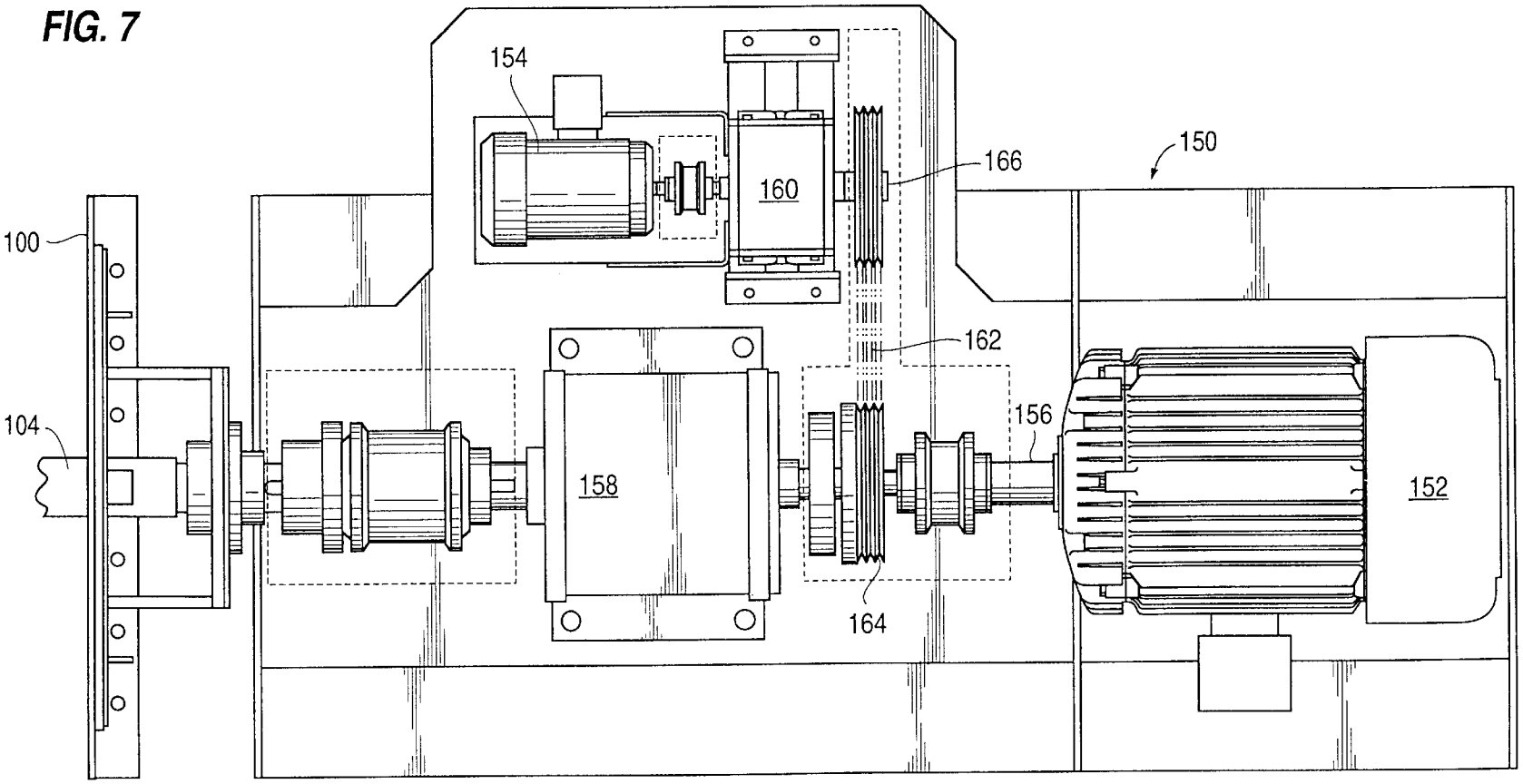
FIG. 7 illustrates a first embodiment of a drive mechanism for providing the rotational motion in accordance with FIGS. 4–6.

FIG. 7 illustrates a first embodiment 150 of a drive mechanism, which contains first and second motors 152 and 154 which are under the control of a control generally in accordance with the Assignee's patents, which has been modified to control motor 154 to produce the rotation of the driven shaft 104 in the first and second directions (not illustrated) to be selectively activated to produce the rotations illustrated in FIGS. 4–6. The motor 152 supplies the power for rotation of the drive shaft 104 in the phases of FIGS. 4 and 6. A speed reducer 158 applies speed reduction to the output shaft 156 of motor 152. Motor 154 applies power to the shaft 104 through a second speed reducer 160 and belt drive 162 which drives a pulley 164 which is attached to the input of speed reducer 158. Clutch 166 under the control of the control (not illustrated) selectively disengages motor 154 from driving shaft 104 when motor 152 is activated. The combination of the speed reducers 158 and 160 permits a smaller motor 154 to be used in comparison to motor 152 because of the additional speed reduction which has sufficient torque to drive the driven shaft 104 at a relatively slower rotation in directions 116 and 118 than the one-way rotations 106 and 124 produced by motor 152 and to also drive the rotor of motor 152. When the operational phase of FIG. 5 is required, motor 154 is started with the clutch 162 engaged to drive through gear reducer 160 and gear reducer 158 to driven shaft 104 to achieve a lower rotational speed than utilized for the rotation of FIGS. 4 and 6. The motor 154 is driven by the combination of a timer and a direction reverser to produce the alternative rotation in directions 116 and 118. It should be understood that the chamber 100 may be in accordance with diverse designs not limited to the configuration of the Assignee's Patents described in FIGS. 1–3 and may be as generally described in FIGS. 4–6.

Figure 8B:
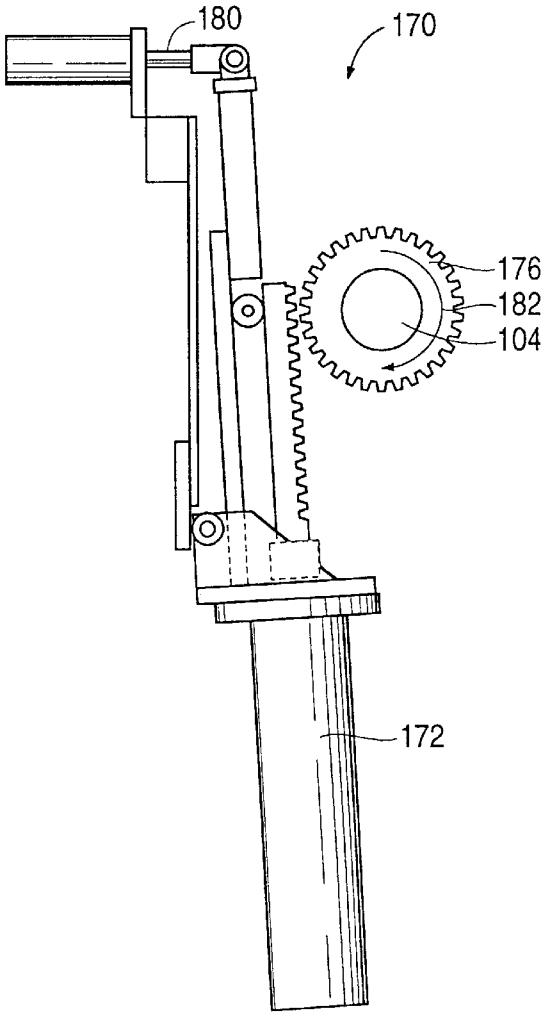
FIGS. 8A and 8B respectively illustrate a second embodiment of a drive mechanism for providing the rotational motion in accordance with FIGS. 4–6.
Figure 8A:
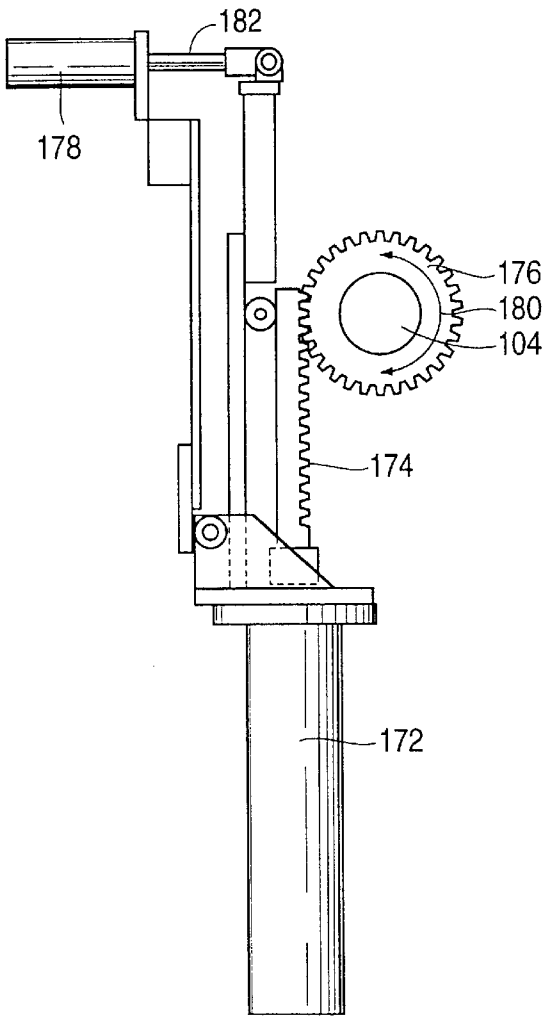

FIGS. 8A and 8B illustrate a second embodiment 170 of a drive mechanism which may be utilized in accordance with the present invention for producing the rotation of the drive shaft 104 in the first direction 116 and the second direction 118 as illustrated in FIG. 5. FIG. 8A represents the drive mechanism 170 in an engaged position and FIG. 8B illustrates the drive mechanism in a disengaged position. The drive mechanism 170 is hydraulically or pneumatically powered utilizing a first power cylinder 172 for stroking a rack 174 which meshes with pinion 176 attached to shaft 104 and an activation cylinder 178 which pivots the rack 174 from the engaged position as illustrated in FIG. 8A to the disengaged position as illustrated in FIG. 8B. All operations of the drive mechanism are under the control of the controller of FIGS. 1–3 as modified to permit two-way rotation. The bidirectional arrow 180 represents the rotation in the first direction 116 and the second direction 118 of FIG. 5. When the piston of the cylinder 178 is activated, arm 182' extends causing the meshing of the rack 174 with the pinion 176. The pinion 176 is provided with sufficient play to allow the teeth respectively of the rack 174 and the pinion 176 to engage when the rack is pivoted toward the pinion regardless of the relative position of the teeth. The power cylinder 172 strokes the rack 174 up and down as illustrated in FIG. 8A. Limit switches (not illustrated) in association with the rack 174 sense the limits of motion of the rack 174 between the ends of stroke thereof. Each limit switch senses the end of stroke which provides a signal to the control (not illustrated) of the main cylinder 172 to reverse its direction of extension causing the rack 174 to reverse direction which changes the direction of rotation of the pinion 176. A selector switch (not illustrated) associated with the control may be used to switch the system from the motion of FIG. 4 to the bidirectional rotation of FIG. 5 and back to the rotation of FIG. 6.

This switch activates the cylinder 178 to engage and disengage the rack and pinion drive as illustrated. The power cylinder 172 is capable of supplying the high torque which is necessary to perform the lifting function of the viscous material 121 of FIG. 5.

Furthermore, from time to time it is desirable to rotate the chamber 100 relative to the engagement with the elements 110 in order to sweep out a different angular section 114 of the chamber 100. The aforementioned switching may be utilized to deactivate the hydraulic cylinder 172 to permit the chamber to be moved relative to the elements 110 (indexing) to sweep out a different angular section of the inside surface 114 of the chamber 100 wall to facilitate increased working of the material to prevent collection on the inside wall of the chamber in an area not swept out by the elements 110 moving through their limited angular oscillation at a spaced position from the inside surface 114 of the chamber 100. This indexing operation may be visualized with respect to FIG. 5 by stopping the rotation of shaft 104 and moving the chamber 100 through a relative angular rotation sufficient that the outside surface of the elements 110 sweep out a different inside angular path of the surface 114 of the chamber 100.

Figure 9B:
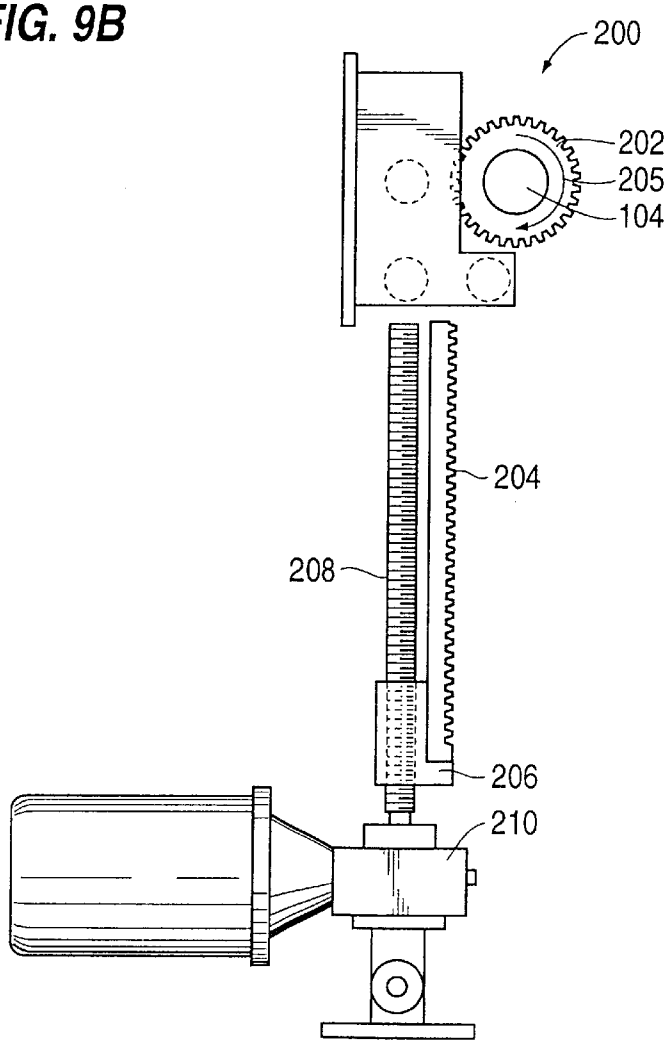
FIGS. 9A and 9B illustrate a third embodiment of a drive mechanism for providing the rotational motion in accordance with FIG. 5.
Figure 9A:
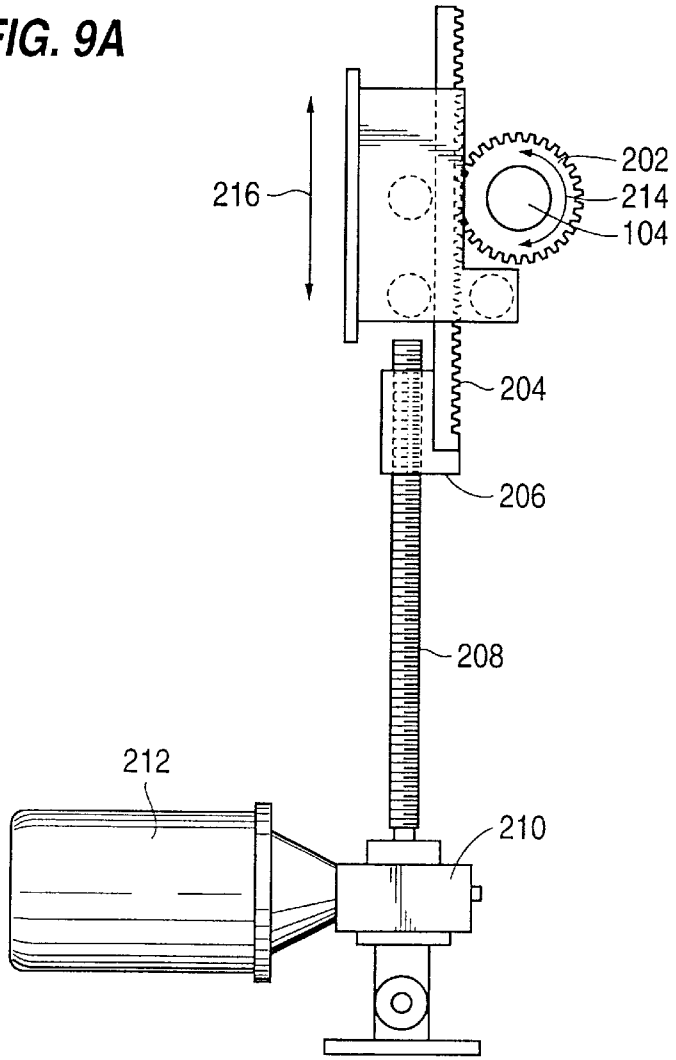

FIGS. 9A and 9B respectively illustrate a third embodiment 200 of the drive mechanism in accordance with the present invention for producing the rotation of the driven shaft 104 in the first and second directions 116 and 118. In the disengaged position, as illustrated in FIG. 8B, rotation of the shaft 104 may occur in direction 181 corresponding to directions 106 and 124 as illustrated in FIGS. 4 and 6. FIG. 9A illustrates the engaged position and FIG. 9B illustrates the disengaged position for producing the rotations in directions 116 and 118. A pinion 202 is attached to driven shaft 104 as in the embodiment 170 of the drive mechanism described above in conjunction with FIGS. 8A and 8B. A rack 204 is attached to a block 206 containing a ball screw which is threaded to engage a corresponding threaded drive rod 208 which is driven through a speed reducer 210 by reversible motor 212. The bidirectional arrow 214 represents the rotation of the drive shaft 104 in the first direction 116 and in the second direction 118. Switches (not illustrated), similar to those described above with reference to FIGS. 8A and 8B, sense the limits of travel which are indicated by the ends of the arrow 216. A conventional direction reversing circuit is used to cause the motor to rotate in the first and second directions 116 and 118. While preferably the connection assembly 206 is a ball screw but this embodiment is not limited thereto. The position of the chamber 100 may be indexed relative to the driven shaft 104 in the same manner as described above in conjunction with FIGS. 8A and 8B. Additionally, limit switches are used (not illustrated) in a manner analogous to the embodiment of FIGS. 8A and 8B to control reversing of motion of the driven shaft at the end of stroke of the block 206.

Figure 10B:
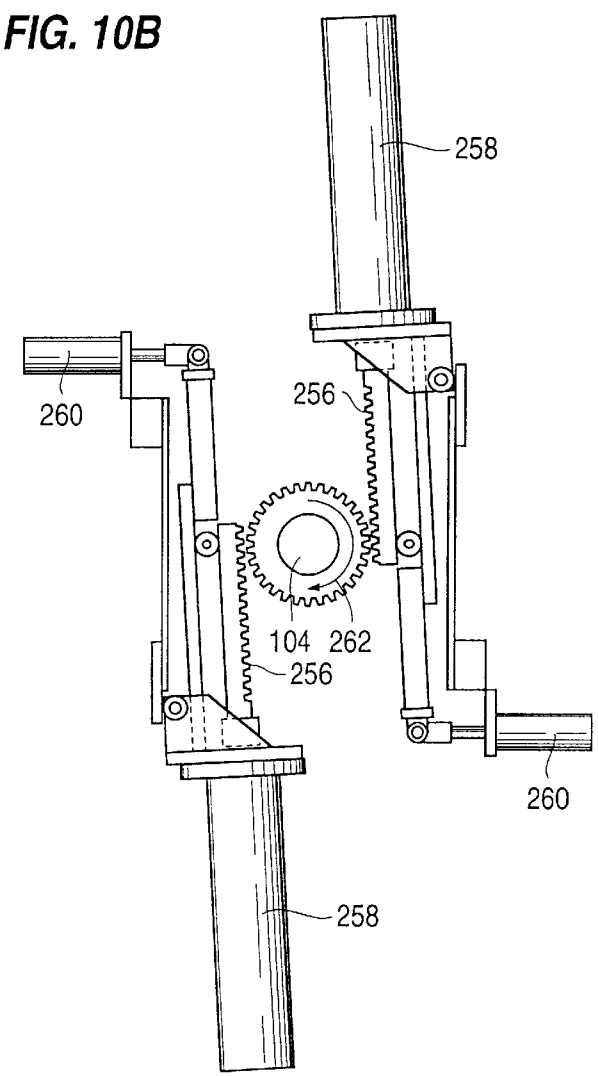
FIGS. 10A and 10B illustrate a fourth embodiment of a drive mechanism for providing the rotational motion in accordance with FIG. 5.
Figure 10A:
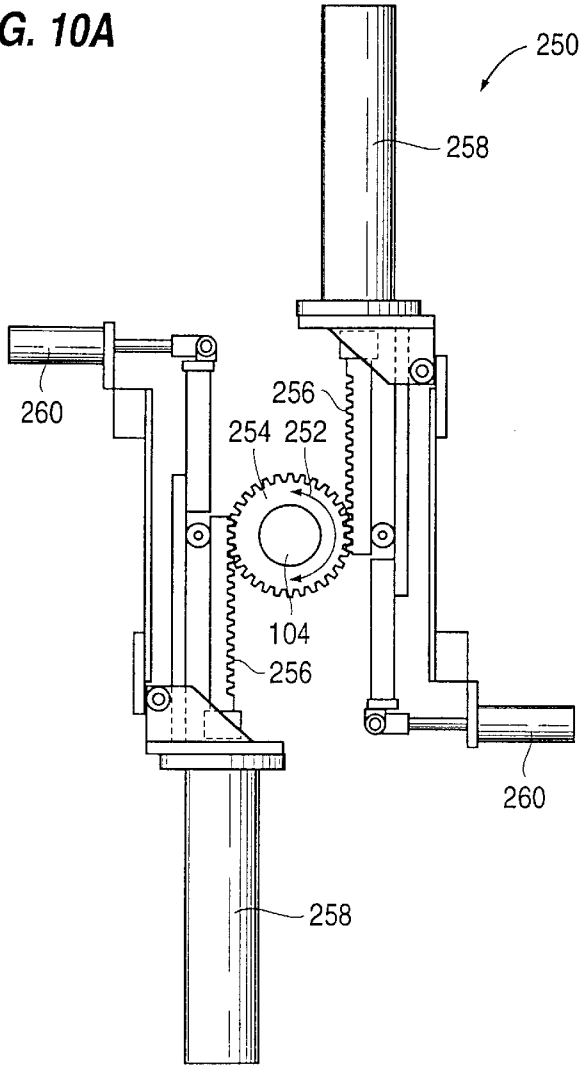

FIGS. 10A and 10B illustrate a fourth embodiment 250 of a drive mechanism for driving shaft 104 with FIG. 10A illustrating the engaged position and FIG. 10B illustrating the disengaged position. The operation of the fourth embodiment 250 is similar to the embodiment of the drive mechanism 170 of FIGS. 8A and 8B except that an additional power and activation cylinders are used to 35 engage and disengage a second rack 256 from driving pinion 254. In the engaged position of FIG. 10A, rotation represented by arrow 252 corresponds to the rotational directions 116 and 118 of FIG. 5. In the disengaged position, as illustrated in FIG. 10B, rotation of the shaft 104 may occur in one direction 262 corresponding to directions 106 and 124 as illustrated in FIGS. 4 and 6. A pair of main actuators 258 stroke the pair of racks 256 between travel limits in the same manner as described above in conjunction with the driving mechanism 170 of FIGS. 8A and 8B. The bidirectional arrow 253 represents the rotation of the driven shaft 104 in the first and second directions 116 and 118 of FIG. 5. Similarly, actuator 260 positions the pair of racks 256 between the engaged position as illustrated in FIG. 10A and the disengaged position as illustrated in FIG. 10B. It should be understood that the drive mechanism for the shaft 104 for producing rotation in one direction represented by arrow 262 to provide the processing illustrated in FIGS. 4 and 6 may be accomplished with a main motor 152 in accordance with FIG. 7. The position of the chamber may be indexed relative to the driven shaft 104 in the same manner as described above in conjunction with FIGS. 8A and 8B. Additionally, limit switches are used (not illustrated) in a manner analogous to the embodiment of FIGS. 8A and 8B to control reversing of motion of the driven shaft 104 at the end of the stroke of the racks 256.

The prime mover and drive mechanism for rotating the shaft 104 in the one direction 106 and 124, as illustrated in FIGS. 4 and 6, is coupled to the shaft 104 at a point projecting orthogonally from the plane of FIGS. 8A and 8B, 9A and 9B and 10A and 10B, and may be similar to motor 152 and speed reducer of FIG. 7.

FIGS. 11A–11D illustrate different configurations of elements 110 which may be utilized with the processing phases of FIGS. 4–6. However, it should be understood that the present invention is not limited to the elements 110 as illustrated in FIGS. 11A–11D.

The element 110 of FIG. 10A is a single V-shaped element 260. Outside peripheral surface 261 during normal operation is spaced a small distance from the inside circumference 114 of the chamber 100, represented by the dashed line 262, to lessen wear.

The element 110 of FIG. 10B is double V-shaped element 264. Outside outer peripheral surface 266 during normal operation is spaced a small distance from the inside circumference 114 of the chamber 100 (represented by dashed line 262) to lessen wear.

Figure 11A:
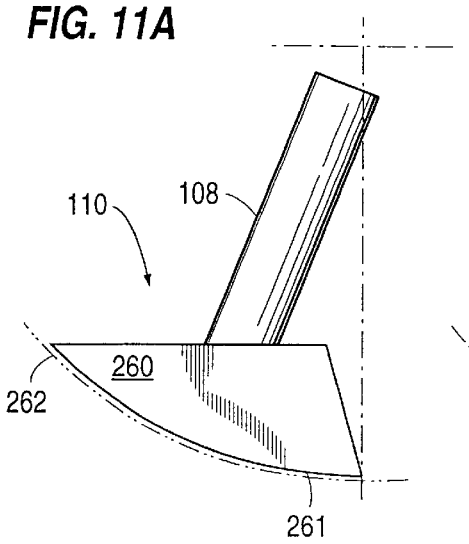
FIGS. 11A–11D illustrate various configurations of the at least one element which is attached to the driven shaft for performing the processing phases of FIGS. 4–6.
Figure 11B:
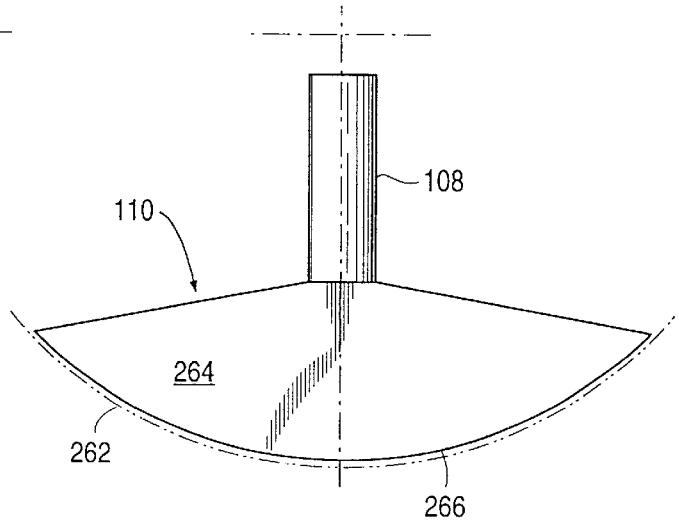
Figure 11C:
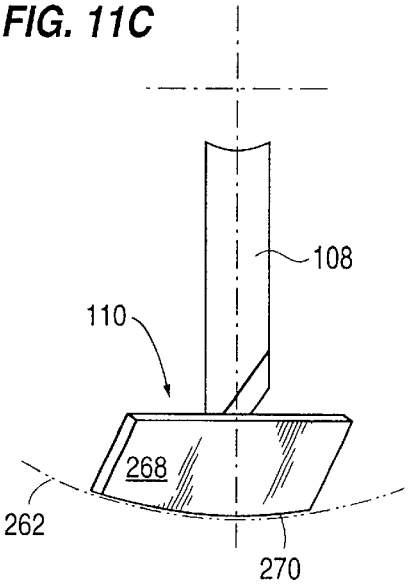

The element 110 of FIG. 11C is a scraping style element 268. Outside peripheral surface 270 during normal operation is spaced a small distance from the inside circumference 114 of the chamber 100, represented by a dashed line 262 to lessen wear.

Figure 11D:
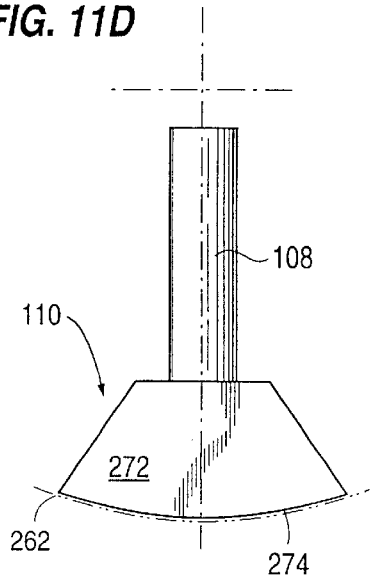

The element 110 illustrated in FIG. 11D is a paddle style element 272. Outside periphery 274 during normal operation is spaced a small distance from the inside circumference 114 of the chamber 100 represented by dashed line 262 to lessen wear.

These diverse shapes of elements 110, which are preferably utilized for mixing and granulation, facilitate the lifting operation of FIG. 5 as well as the agitation and removal of the liquid in FIG. 4 and granulation in FIG. 6.

While the invention has been illustrated in the form of its preferred embodiments, including diverse processing phases and an apparatus for performing those processing phases, it should be understood that the invention is not limited thereto. Numerous modifications may be made to the invention without departing from the spirit and scope thereof. It is intended that all such modifications fall within the scope of the appended claims.

What is claimed is:

1. An apparatus for processing material comprising:

a chamber for containing the material, a rotatably driven shaft extending within the chamber to which is attached at least one element which engages the material in the chamber during rotation thereof, a drive mechanism for rotating the rotatably driven shaft, at least one of a heat source thermally coupled to the chamber for adding heat to the chamber and a vacuum source also coupled to the chamber for applying a vacuum to the chamber with the at least one source driving off liquid present in the chamber and a control for controlling the drive mechanism and the at least one source and wherein:

the control controls the at least one source during rotation in first and second directions and the drive mechanism to rotate the driven shaft in a first direction to cause the at least one element to engage the material, in a fluid state, while the chamber is partially filled with the material through an angular rotation which lifts the material upward beyond a level of the material in the chamber without reaching a position which is directly above the driven shaft while the at least one source drives off liquid in the material and the control controls the drive mechanism to rotate the driven shaft in a second direction, opposite to the first direction, to cause the at least one element to engage the material, in a fluid state, through an angular rotation which lifts the material beyond the level of the material in the chamber without reaching a position which is directly above the driven shaft while the at least one source drives off liquid in the material; and after rotation of the driven shaft in the first and second directions the control controls the drive mechanism to rotate the driven shaft in one direction and the at least one source to drive off the liquid to produce dried material during the rotation in the one direction.

2. An apparatus in accordance with claim 1 wherein:

the control controls the drive mechanism to rotate the driven shaft in the first and second directions while the material is sufficiently viscous that the material would stick to the driven shaft if the material were to contact the drive shaft.

3. An apparatus in accordance with claim 2 wherein:

the control controls the drive mechanism to rotate the driven shaft through a plurality of sequential cycles with each cycle including rotation in the first and second directions.

4. An apparatus in accordance with claim 3 wherein:

the control controls the drive mechanism to rotate the driven shaft in one direction to cause the material to increase in viscosity prior to controlling the drive mechanism to rotate the driven shaft in the first and second directions; and after completion of rotating of the driven shaft in the first and second directions, the control controls the drive mechanism to rotate the driven shaft in one direction to particularize the material.

5. An apparatus in accordance with claim 4 wherein the drive mechanism comprises:

a first prime mover, which is controlled by the control, which rotates the driven shaft in the one direction; and a second prime mover, which is controlled by the control, which rotates the driven shaft in the first and second directions.

6. An apparatus in accordance with claim 5 further comprising:

the vacuum source, coupled to the chamber, applies vacuum to the chamber to drive off liquid present in the material.

7. An apparatus in accordance with claim 4 wherein:

the heat source adds heat to the material during the rotations of the driven shaft in the one direction and during the rotation of the driven shaft in the first and the second directions.

8. An apparatus in accordance with claim 2 wherein:

the control controls the drive mechanism to rotate the driven shaft in one direction to cause the material to increase in viscosity prior to controlling the drive mechanism to rotate the driven shaft in the first and second directions; and after completion of rotating of the driven shaft in the first and second directions, the control controls the drive mechanism to rotate the driven shaft in one direction to particularize the material.

9. An apparatus in accordance with claim 8 wherein the drive mechanism comprises:

a first prime mover, which is controlled by the control, which rotates the driven shaft in the one direction; and a second prime mover, which is controlled by the control, which rotate the driven shaft in the first and second directions.

10. An apparatus in accordance with claim 9 further comprising:

the vacuum source, coupled to the chamber, applies vacuum to the chamber to drive off liquid present in the material.

11. An apparatus in accordance with claim 8 wherein:

the heat source adds heat to the material during the rotations of the driven shaft in the one direction and during the rotation of the driven shaft in the first and the second directions.

12. An apparatus in accordance with claim 3 wherein:

the heat source adds heat to the material during rotation of the driven shaft through the plurality of sequential cycles to drive off liquid present in the material.

13. An apparatus in accordance with claim 3 further comprising:

the vacuum source, coupled to the chamber, applies vacuum to the chamber to drive off liquid present in the material.

14. An apparatus in accordance with claim 2 wherein:

the heat source adds heat being added to the material during controlling rotation of the driven shaft in the first and the second directions to drive of f liquid present in the material.

15. An apparatus in accordance with claim 2 further comprising:

the vacuum source, coupled to the chamber, applies vacuum to the chamber to drive off liquid present in the material.

16. An apparatus in accordance with claim 1 wherein:

the control controls the drive mechanism to rotate the driven shaft through a plurality of sequential cycles with each cycle including rotation in the first and second directions.

17. An apparatus in accordance with claim 16 wherein:

the control controls the drive mechanism to rotate the driven shaft in one direction to cause the material to increase in viscosity prior to controlling the drive mechanism to rotate the driven shaft in the first and second directions; and after completion of rotating of the driven shaft in the first and second directions, the control controls the drive mechanism to rotate the driven shaft in one direction to particularize the material.

18. An apparatus in accordance with claim 17 wherein the drive mechanism comprises:

a first prime mover, which is controlled by the control, which rotates the driven shaft in the one direction; and a second prime mover, which is controlled by the control, which rotates the driven shaft in the first and second directions.

19. An apparatus in accordance with claim 18 further comprising:

the vacuum source, coupled to the chamber, applies vacuum to the chamber to drive off liquid present in the material.

20. An apparatus in accordance with claim 17 wherein:

the heat source adds heat to the material during the rotations of the driven shaft in the one direction and during the rotation of the driven shaft in the first and the second directions.

21. An apparatus in accordance with claim 14 wherein:

the heat source adds heat to the material during rotation of the driven shaft through the plurality of sequential cycles to drive off liquid present in the material.

22. An apparatus in accordance with claim 16 further comprising:

the vacuum source, coupled to the chamber, applies vacuum to the chamber to drive off liquid present in the material.

23. An apparatus in accordance with claim 1 wherein:

the control controls the drive mechanism to rotate the driven shaft in one direction to cause the material to increase in viscosity during the rotation in one direction prior to controlling the drive mechanism to rotate the driven shaft in the first and second directions; and after completion of rotating of the driven shaft in the first and second directions, the control controls the drive mechanism to rotate the driven shaft in one direction to particularize the material.

24. An apparatus in accordance with claim 23 wherein the drive mechanism comprises:

a first prime mover, which is controlled by the control, which rotates the driven shaft in the one direction; and a second prime mover, which is controlled by the control, which rotates the driven shaft in the first and second directions.

25. An apparatus in accordance with claim 24 further comprising:

the vacuum source, coupled to the chamber, applies vacuum to the chamber to drive off liquid present in the material.

26. An apparatus in accordance with claim 23 wherein:

the heat source adds heat to the material during the rotations of the driven shaft in the one direction and during the rotation of the driven shaft in the first and the second directions to drive off liquid present in the material.

27. An apparatus in accordance with claim 1 wherein:

the heat source adds heat to the material during rotation of the driven shaft in the first and the second directions to drive off liquid present in the material.

28. An apparatus in accordance with claim 1 wherein:

the at least one element is spaced from a wall of the chamber.

29. An apparatus in accordance with claim 1 further comprising:

the vacuum source, coupled to the chamber, applies vacuum to the chamber to drive off liquid present in the material.

30. An apparatus for processing material comprising:

a chamber for containing the material, a rotatably driven shaft extending within the chamber to which is attached at least one element which engages the material in the chamber during rotation thereof, a drive mechanism for rotating the rotatably driven shaft, at least one of a heat source thermally coupled to the chamber for adding heat to the chamber and a vacuum source also coupled to the chamber for applying a vacuum to the chamber with the at least one source driving off liquid present in the chamber and a control means for controlling the drive mechanism and the at least one source and wherein:

the control means controls the at least one source during rotation in first and second directions and the drive mechanism to rotate the driven shaft in a first direction to cause the at least one element to engage the material, in a fluid state, while the chamber is partially filled with the material through an angular rotation which lifts the material upward beyond a level of the material in the chamber without reaching a position which is directly above the driven shaft while the at least one source drives off liquid in the material and the control means controls the drive mechanism to rotate the driven shaft in a second direction, opposite to the first direction, to cause the at least one element to engage the material, in a fluid state, through an angular rotation which lifts the material beyond the level of the material in the chamber without reaching a position which is directly above the driven shaft while the at least one source drives off liquid in the material; and after rotation of the driven shaft in the first and second directions, the control means controls the drive mechanism to rotate the driven shaft in one direction and the at least one source to drive off the liquid to produce dried material during the rotation in the one direction.

* * * * *